United States Patent [19]

Busch

[11] Patent Number: 4,549,714

[45] Date of Patent: Oct. 29, 1985

[54] ROTATABLE STAND

[75] Inventor: Erwin Busch, Arolsen, Fed. Rep. of Germany

[73] Assignee: Thermohauser Erwin Busch GmbH, Uhingen, Fed. Rep. of Germany

[21] Appl. No.: 541,586

[22] Filed: Oct. 13, 1983

[30] Foreign Application Priority Data

Dec. 17, 1982 [DE] Fed. Rep. of Germany ..... 3246835

[51] Int. Cl.[4] ..... A47B 91/00

[52] U.S. Cl. ..... 248/349; 248/221.4

[58] Field of Search ..... 248/349, 131, 183, 186, 248/425, 221.4

[56] References Cited

U.S. PATENT DOCUMENTS

| | | | |
|---|---|---|---|
| 3,409,265 | 11/1968 | Wichers et al. | 248/349 X |
| 3,713,619 | 1/1973 | Marty | 248/425 |
| 4,026,067 | 5/1977 | Wengel | 248/131 X |
| 4,117,627 | 10/1978 | Slingerland, Jr. | 248/349 X |
| 4,301,987 | 11/1981 | Conway | 248/221.4 |
| 4,330,696 | 5/1982 | Pomeroy et al. | 248/349 X |

FOREIGN PATENT DOCUMENTS

| | | | |
|---|---|---|---|
| 845927 | 8/1952 | Fed. Rep. of Germany | 248/349 |
| 814613 | 6/1959 | United Kingdom | 248/349 |

*Primary Examiner*—J. Franklin Foss
*Assistant Examiner*—David L. Talbott
*Attorney, Agent, or Firm*—Seymour Levine

[57] ABSTRACT

A stand with a rotatable tray positioned thereon. A race formed by a circular groove on the top of a base section and a corresponding circular groove on the underside of the tray permits the tray to rotate on ball bearings held in a ring and positioned in the race. While rotating, lateral motion is curtailed by flared tabs extending from the underside of the tray through an aperture on the top of the base section.

4 Claims, 2 Drawing Figures

ROTATABLE STAND

BACKGROUND OF THE INVENTION

1. Field of the Invention

The invention pertains to the field of support stands for work pieces and more particularly to rotatable stands for holding and rotating cakes during the cake decoration process.

2. Description of the Prior Art

A cake as it is taken from the oven, or assembled with layers as taken from the oven, without icing decorations is incomplete, appears bare, and does not present a sufficiently appetizing appearance to attract appreciable customer attention. Additionally, to many customers the icing on the cake is the main taste attraction. Icing decorations are applied to all the bare surfaces of the cake while the cake is on a rotatable stand to allow the decorator to rotate the cake while applying the icing.

One rotatable stand of the prior art utilized a tray with a centered post or spindle on the underside. This post, which possesses a conically tapered end section, is inserted into a hollow tube, which has a matching conically tapered inner end, protruding from a base section. The dimensions of the base and the length of the tube insure stability of the post supported trays as the post is rotated in the hollow tube. Since the post cannot be removed from the tray, the decorated cake must be taken from the tray for display and sale.

Another rotatable stand of the prior art, mainly for non-professional use, has a circular lip on the underside of the rotatable tray wherewithin a ball bearing ring is placed. A ball bearing ring retaining section, with a circular channel into which the bearing ring is held, is positioned within the circular lip beneath the ball bearing ring and held permanently in place by tabs protruding inwardly from the end of the circular lip over a circular portion of the retaining section which extends perpendicularly from the ring holding channel. This portion of the bearing ring retaining section has an outer diameter sufficiently smaller than the inner diameter of the lip to allow easy rotation of the tray. The clearance provided for easy rotation, however, allows lateral motion of the tray as it rotates, which may effect the decoration. The ring retaining section also serves as the base of the stand. Additionally, the overall height of this section is in the order of one quarter of an inch, which does not provide sufficient clearance from the table top, on which the rotating stand is placed, nor may the tray be removed from the assembly, necessitating the removal of the cake for display and sale.

SUMMARY OF THE INVENTION

A rotatable stand made in accordance with the principles of the present invention may comprise a circular rotating tray, a circular base, and ball bearing ring therebetween. A circular grove is positioned on the underside of the tray, about which a circular lip extends substantially perpendicularly downward, the center of the grove and lip being at the center of the tray. Four tabs, extending from the underside of the tray at a selected angle from the perpendicular thereto, are equally spaced about a circle that is concentric with the grove and lip, but of a diameter significantly smaller than the diameter of the grove.

The base has a circular top with a centered circular aperture, into which the angled tabs on the underside of the tray may be inserted, and a centered circular grove of diameter equal to the diameter of the grove on the underside of the tray. The outer diameter of the top is slightly smaller than the inner diameter of the lip on the tray. The base extends downward from the top as a circular cylinder to a shoulder for a distance that is slightly greater than the length of the lip. From this shoulder a flared section extends to a circular flange. When assembled the bearings of the bearing ring are positioned in the groves on the top of the base and the underside of tray so that the two groves form a bearing race for the rotation of the tray about the base.

DESCRIPTION OF THE PREFERRED EMBODIMENT

Figure 1:
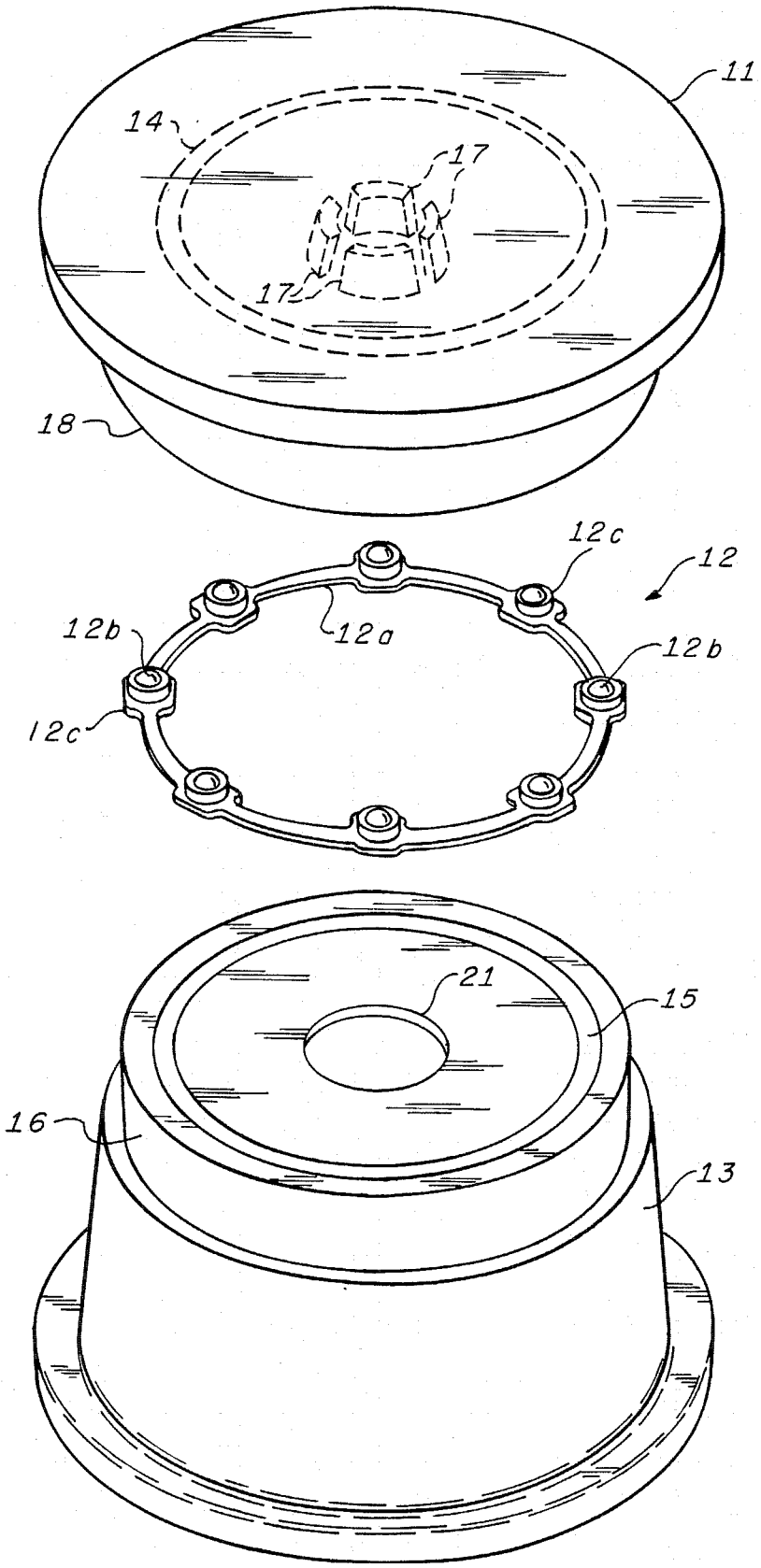
FIG. 1 is a parts breakdown drawing illustrating the three major components of the invention.

Referring to FIG. 1, a preferred embodiment of a rotatable stand 10 may include a tray 11, a ball bearing ring 12, and a base 13. A circular grove 14, on the underside and concentric with the tray 11, and a circular grove 15, atop and concentric with a cylindrical section 16 crowning the base 13, are each of a diameter substantially equal to the diameter of the bearing ring 12. Such rings, wherein ball bearings **12*b* are held in sprockets 12*c* that are substantially equally spaced by lengths 12*a* of the same plastic material that comprise the sprockets, are well known in the art. On the tray 11 are tabs 17 equally spaced about a circle which is concentric with a cylindrical lip 18 of inner diameter slightly greater than the diameter of the cylindrical section 16, both extending from the underside thereof. An aperture 21, of diameter to accept the tabs 17, is positioned through the top of the cylindrical section 16 concentric with the grove 15. The rotatable stand 10 is assembled to accept a cake for decoration by placing the bearing 12 on top of the cylindrical section 16 substantially in the grove 15 and positioning the tray 11, with the tabs 17 thereof in the aperture 21, such that the groves 14 and 15 form a race for the bearing 12 seated therebetween and the cylindrical lip 18 extends over the cylindrical section 16. This arrangement permits the removal of the tray 11** with the cake thereon and allows for its sale as a disposable cake base, a feature of the rotatable stand of this invention that does not exist in the cake decorating stands of the prior art.

Figure 2:
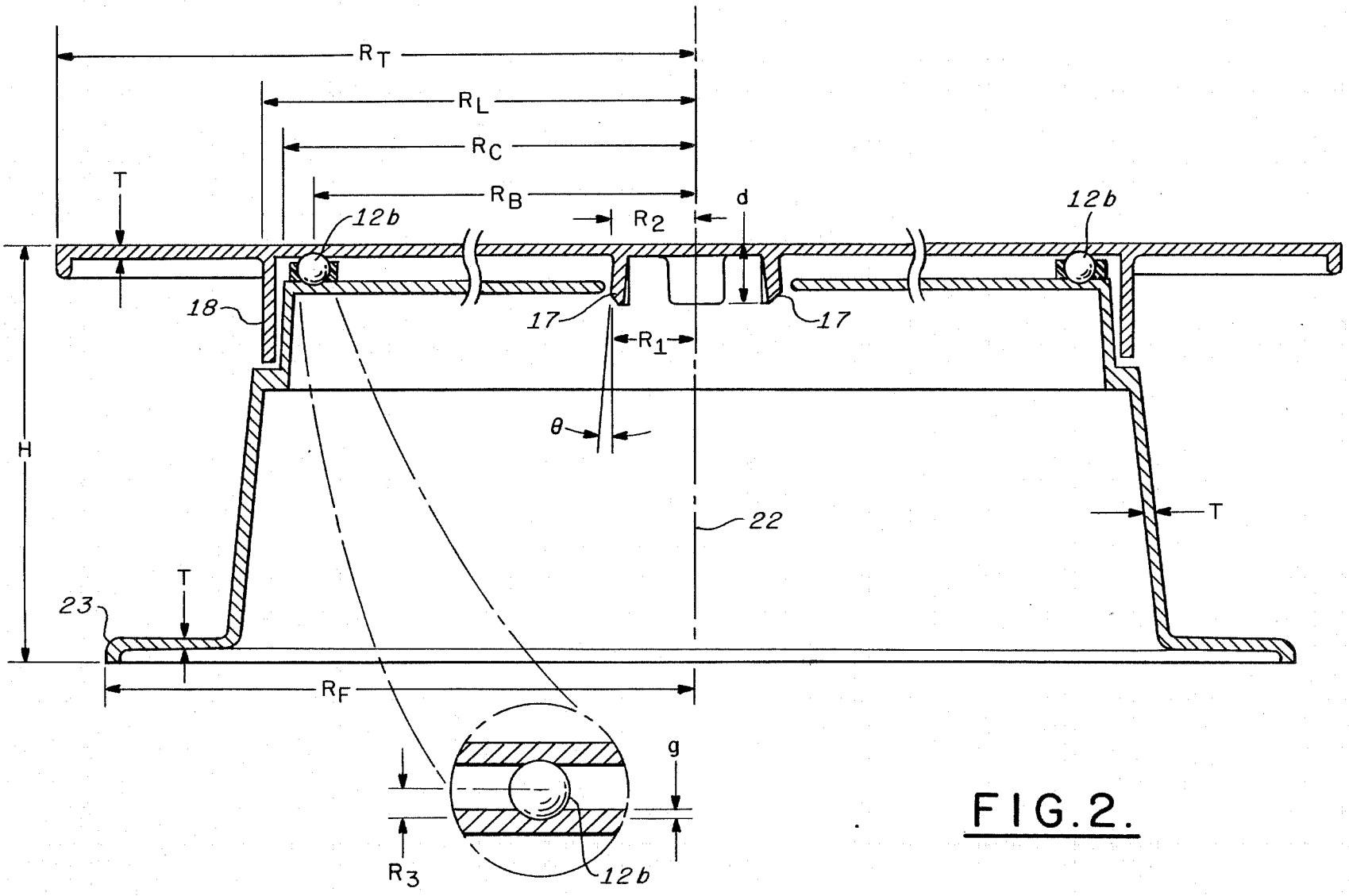
FIG. 2 is a cross-sectional view taken through the center of an assembled rotatable stand made in accordance with the principles of the invention.

A cross sectional view through the center of the assembled rotatable stand 10, which may be made of a plastic material, as for example polystyrol, is shown in FIG. 2. The tabs 17 extend downward from the underside of the tray 11, for a distance d from the top of approximately 12 mm, at an angle $\theta$ with respect to the perpendicular that may be substantially 5°, such that the distance $r_1$ from the center line 22 of the rotatable table to the furthest point therefrom on each tab may be approximately 17 mm, slightly greater than the radius $r_2$ of the aperture 21, which may be in the order of 16.75 mm. This selection of aperture radius, tab flare, and tab length permits the tray to rotate freely on the ball bearing ring with substantially no movement transverse to the axis of rotation. Additionally, this arrangement substantially eliminates tray tilt when the cake is not centered on the tray. Of course the dimensions of the aperture 21 and tabs 17 are functions of the tray radius $R_T$ which, for the dimensions above given, may be in the order of 158 mm.

A radius $R_B$ for the ball bearing ring 12 consistent with the above referenced tray radius $R_T$ would be in the order of 107.5 mm. Each ball bearing 12*b* may have a radius $r_3$ of 3 mm. The radius of curvature for each of the groves 14 and 15 should be substantially equal to the radius of the ball bearings and each grove 14, 15 may have an arcuate length that provides a grove depth g of approximately 0.5 mm. Further, the inner radius $R_L$ of the cylindrical lip 18 may be 165.75, while the outer radius $R_c$ of the cylindrical section 16 may be 165 mm. The thickness T of the plastic material for all sections of the tray 11 and base 13 may be 2 mm. A circular flange 23 of radius $R_F$ substantially equal to 150 mm, may extend horizontally from the bottom of the base for positioning the rotatable stand 10 on a work surface from which the rotatable stand 10 may rise to an overall height H of 88 mm.

While the invention has been described in its preferred embodiments, it is to be understood that the words which have been used are words of description rather than limitation and that changes may be made within the purview of the appended claims without departing from the true scope and spirit of the invention in its broader aspects.

I claim:

1. A rotatable stand comprising:

a base having a centered circular aperature through a top surface and a first circular grove on said top surface, said grove having a predetermined radius and a radius of curvature in cross section:

a plurality of ball bearings coupled in a ring of radius equal to said predetermined radius, each of said ball bearings positionable in said first circular grove and having a radius equal to said radius of curvature;

a tray having a second circular grove on an underside thereof, said grove having a radius equal to said predetermined radius and a cross section of radius equal to said radius of curvature, said tray removably positionable on said plurality of ball bearings such that said first and second groves form a race for said ball bearings, thereby allowing for rotation of said tray; and a plurality of tabs circularly positioned and having a continuous crossectional contour, extending, at a preselected flare angle from a perpendicular to said underside, through said aperture of said top surface of said base, said tabs having a length and flare angle for each tab such that end sections of said tabs lie on arcs of a circle having a diameter greater than said selected diameter of said aperture, whereby said tray rotates freely on said ball bearings with no movement transverse to said rotation axis of said tray and said tray does not tilt when subjected to an off center load.

2. A rotatable stand in accordance with claim 1 wherein said base includes a cylindrical crown of selected outer radius and said tray includes a cylindrical lip extending from said underside for a preselected length and having an inner radius greater than said outer radius of said crown.

3. A rotatable stand in accordance with claim 1 wherein four tabs comprise said plurality of tabs.

4. A rotatable stand in accordance with claim 1 wherein said flare angle for each tab is equal to five degrees.

* * * * *